US010636549B2

(12) United States Patent
Niitsu

(10) Patent No.: US 10,636,549 B2
(45) Date of Patent: Apr. 28, 2020

(54) ELECTRONIC COMPONENT

(71) Applicant: Molex, LLC, Lisle, IL (US)

(72) Inventor: Toshihiro Niitsu, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/307,421

(22) PCT Filed: Jun. 8, 2017

(86) PCT No.: PCT/US2017/036509
§ 371 (c)(1),
(2) Date: Dec. 5, 2018

(87) PCT Pub. No.: WO2017/214370
PCT Pub. Date: Dec. 14, 2017

(65) Prior Publication Data

US 2019/0189309 A1 Jun. 20, 2019

Related U.S. Application Data

(60) Provisional application No. 62/348,197, filed on Jun. 10, 2016.

(30) Foreign Application Priority Data

Apr. 18, 2017 (JP) ..... 2017-082134

(51) Int. Cl.
*H01C 1/14* (2006.01)
*H01C 1/022* (2006.01)
(Continued)

(52) U.S. Cl.
CPC ..... *H01C 1/14* (2013.01); *H01C 1/01* (2013.01); *H01C 1/02* (2013.01); *H01C 1/022* (2013.01)

(58) Field of Classification Search
CPC ... H01C 1/14; H01C 1/01; H01C 1/02; H01C 1/022
See application file for complete search history.

(56) References Cited

U.S. PATENT DOCUMENTS 4,617,609 A * 10/1986 Utner ..... H01G 2/06 29/25.42
4,786,888 A * 11/1988 Yoneda ..... H01C 7/04 219/505
(Continued)

FOREIGN PATENT DOCUMENTS

CN 1212072 A 3/1999
JP H03-024271 U 3/1991
(Continued)

OTHER PUBLICATIONS

International Search Report and Written Opinion received for PCT application No. PCT/US2017/036509, dated Jul. 31, 2017, 9 pages.
(Continued)

*Primary Examiner* — Kyung S Lee
(74) *Attorney, Agent, or Firm* — Molex, LLC

(57) ABSTRACT

An insulating sheet and a conductive terminal are provided in an electronic component, where at least one of the conductive terminals has a missing part, and where a remaining part positioned on both ends of the missing part is connected through a resistor element affixed to the insulating sheet.

21 Claims, 11 Drawing Sheets

(51) Int. Cl.
*H01C 1/02* (2006.01)
*H01C 1/01* (2006.01)

(56) References Cited

U.S. PATENT DOCUMENTS

| | | | | | |
|---|---|---|---|---|---|
| 4,959,505 | A * | 9/1990 | Ott | H01C 17/006 | 174/536 |
| 5,466,887 | A * | 11/1995 | Hasegawa | H01G 4/224 | 174/524 |
| 5,900,800 | A * | 5/1999 | McGuire | H01C 1/1406 | 338/22 R |
| 6,329,715 | B1 | 12/2001 | Hayashi | | |
| 7,567,163 | B2 | 7/2009 | Dadafshar et al. | | |
| 8,912,876 | B2 * | 12/2014 | Gomi | H01C 7/102 | 338/21 |
| 2003/0176015 | A1 | 9/2003 | Yoon et al. | | |
| 2003/0201870 | A1 | 10/2003 | Kemoto et al. | | |
| 2005/0128678 | A1 | 6/2005 | Hidaka et al. | | |

FOREIGN PATENT DOCUMENTS

| | | | |
|---|---|---|---|
| JP | H06-208902 | A | 7/1994 |
| WO | 2017/214370 | A1 | 12/2017 |

OTHER PUBLICATIONS

International Preliminary Report on Patentability received for PCT Application No. PCT/US2017/036509, dated Dec. 20, 2018, 8 pages.

* cited by examiner

ELECTRONIC COMPONENT

RELATED APPLICATIONS

This application is a national stage of International Application No. PCT/US2017/036509, filed Jun. 8, 2017, which claims priority to U.S. Application No. 62/348,197, filed Jun. 10, 2016, and Japanese Application No. 2017-082134, filed Apr. 18, 2017, all of which are incorporated herein by reference in their entireties.

TECHNICAL FIELD

The present disclosure relates to an electronic component.

BACKGROUND ART

Conventionally, chip shaped electronic components including various elements such as resistors, and the like, are mounted on the substrates of printed circuit boards, and the like (for example, see Patent Document 1).

FIGS. 11A and 11B are diagrams illustrating a conventional electronic component. Note that, FIG. 11A is a perspective view of an electronic component and FIG. 11B is a perspective view of a conductive plate.

In the figure, 801 is a jumper chip, which is one type of electronic component, and is mounted on a surface of a substrate not illustrated the figure. The jumper chip 801 is provided with a plurality of conductive plates 851, and a housing 811 for wrapping and sealing a portion in the vicinity of the center of the conductive plate 851.

The conductive plate 851 is a long slender plate member formed from a conductive metal such as a copper alloy, and the like, and is, as is illustrated in the figure, provided with an L shaped mounting end portion 852 on both ends thereof. Furthermore, the plurality (four in the example illustrated in the figure) of conductive plates 851 are aligned and arrayed so as to be parallel to one another. Furthermore, the housing 811 is made of an insulating resin material, and holds and secures the conductive plates 851, which have been arrayed in parallel.

Moreover, the jumper chip 801 is mounted to a surface of a substrate not illustrated in the figure by using means such as soldering, and the like, to secure the mounting end portions 852 to conductive wires formed on the surface of the substrate.

Patent Document 1: Japanese Unexamined Utility Model (Registration Application Publication No. H03-024271

SUMMARY

However, while the conductive plate 851 is held in the conventional electronic component by the housing 811, because the housing 811 is simply something given a predetermined shape through the solidification of a resin, it is difficult to keep spacing between adjacent conductive plates 851 precisely at a specified dimension, and it is difficult to attach a shield plate so as to maintain a specified gap with the conductive plate 851. In recent years, progress has been made with miniaturization of all kinds of electrical equipment and electronic equipment and, in conjunction with this, progress has also been made with the miniaturization of electronic components mounted on substrates mounted in said electrical equipment and electronic equipment. However, because it is difficult to precisely manage the dimensions of the housing 811 formed through the solidification of a resin, even when miniaturizing an electronic component having a simple structure, like the jumper chip 801, it is even more difficult to precisely maintain the gaps between the conductive plates 851 and the gaps between the shield plate and the conductive plates 851 at predetermined minute dimensions.

Here, an object is to provide an electronic component that is able to resolve the conventional problem described above and reliably demonstrate a desired level of performance, and that has high reliability, low production costs, and high durability, even when miniaturized.

Therefore, insulating sheets and conductor terminals are provided in electronic components, where at least one of the conductor terminals has a missing portion, and where remaining portions positioned on both ends of the missing portion are connected through a resistor element affixed to the insulating sheets.

In other electronic components, the insulating sheets are also provided on both side surfaces of the conductor terminal, and the resistor element is affixed to a surface facing the terminal in at least one of the insulating sheets.

Also, in other electronic components, an outer conductor member, provided on a side surface opposite the surface facing the terminal in the insulating sheet, is also provided, where the conductor terminal includes a first conductor terminal that is electrically connected to the outer conductor member and a second conductor terminal that is not electrically connected to the outer conductor member, and at least one of the second conductor terminals includes the missing portion.

Also, in other electronic components, the outer conductor member also includes a convex portion that makes contact with and is thus electrically connected to a surface of the first conductor terminal, and the insulating sheet includes an opening through which the convex portion can pass.

Also, in other electronic components, an insulating housing—formed integrally with the insulating sheet, the conductor terminal and the outer conductor member—is also provided, and the housing is interposed between adjacent conductor terminals.

According to this disclosure, a desired level of performance can be demonstrated, reliability is high, production costs are low, and durability is high even though an electronic component has been miniaturized.

BRIEF DESCRIPTION OF THE DRAWINGS

FIG. 11A is a perspective view of an electronic component, and FIG. 11B is a perspective view of a conductive plate.

DETAILED DESCRIPTION OF THE PREFERRED EMBODIMENTS

The embodiments will be described in detail below with reference to the drawings.

Figure 1:
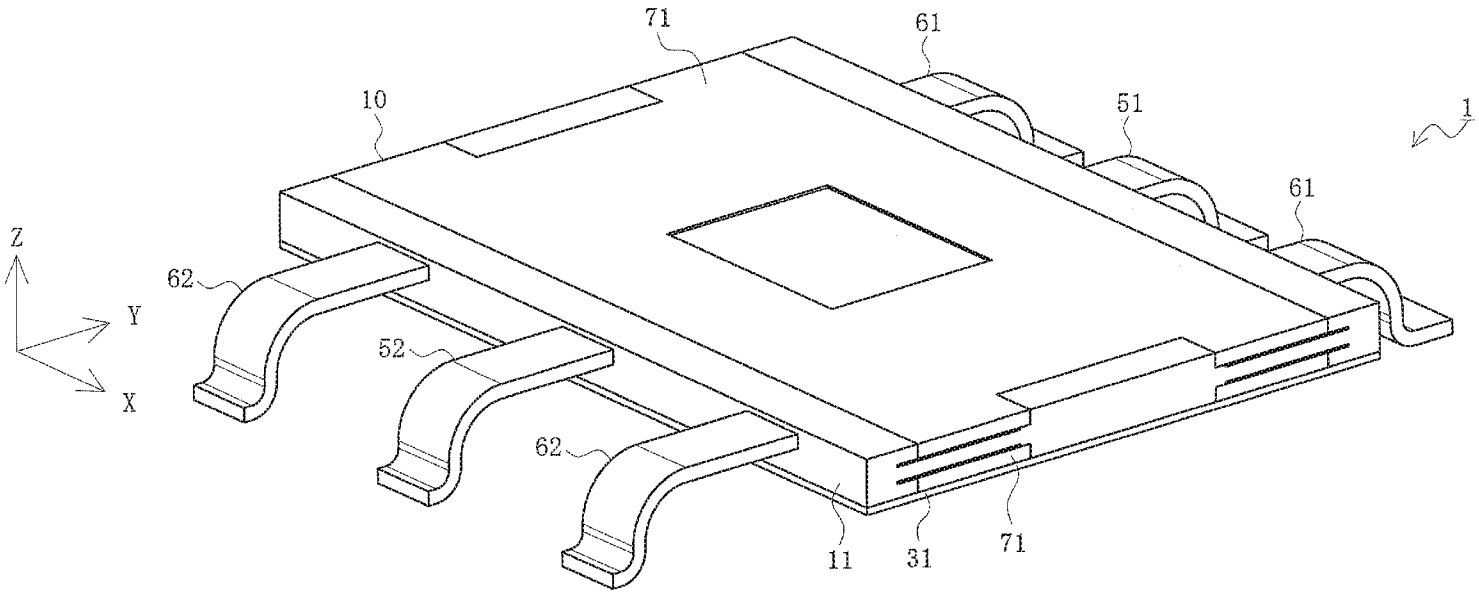
FIG. 1 is a perspective view illustrating an electronic component in the present embodiment.
Figure 2:
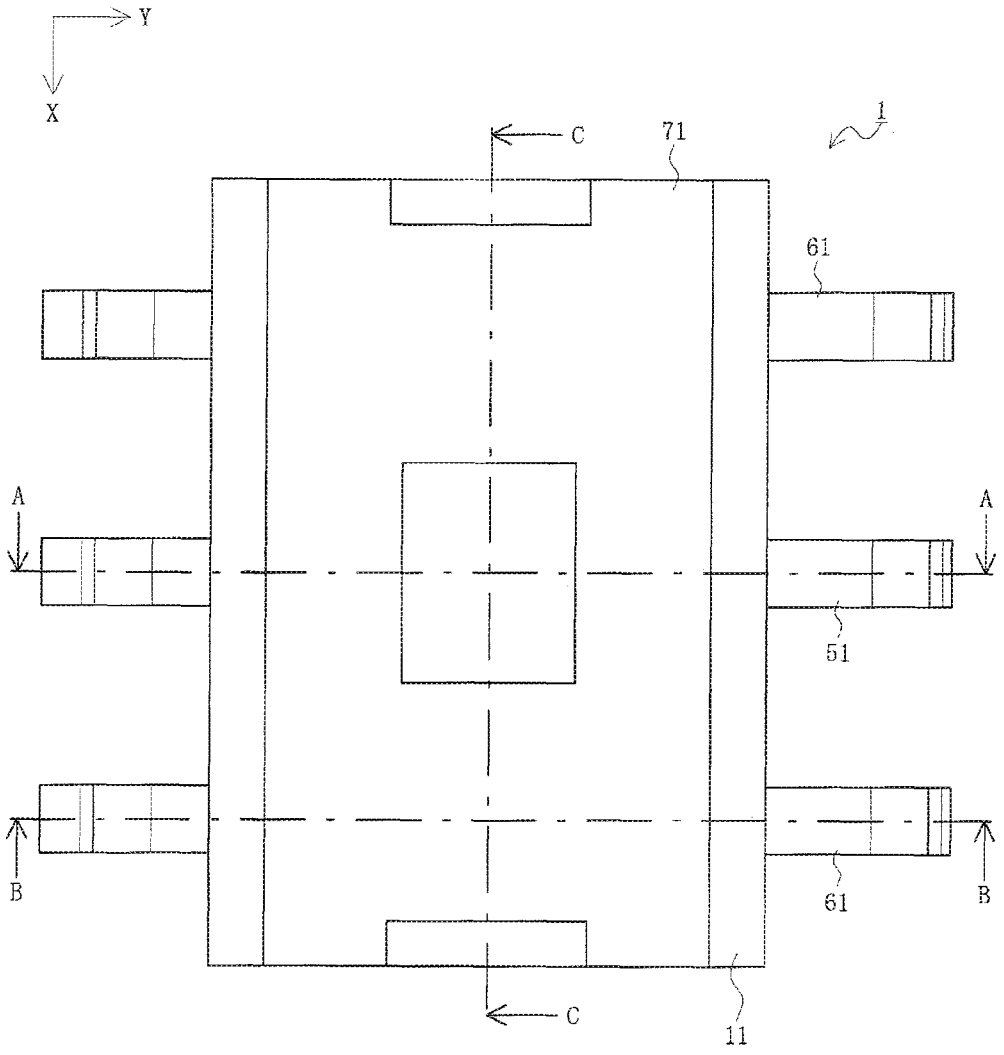
FIG. 2 is a top surface view of the electronic component in the present embodiment.
Figure 3:
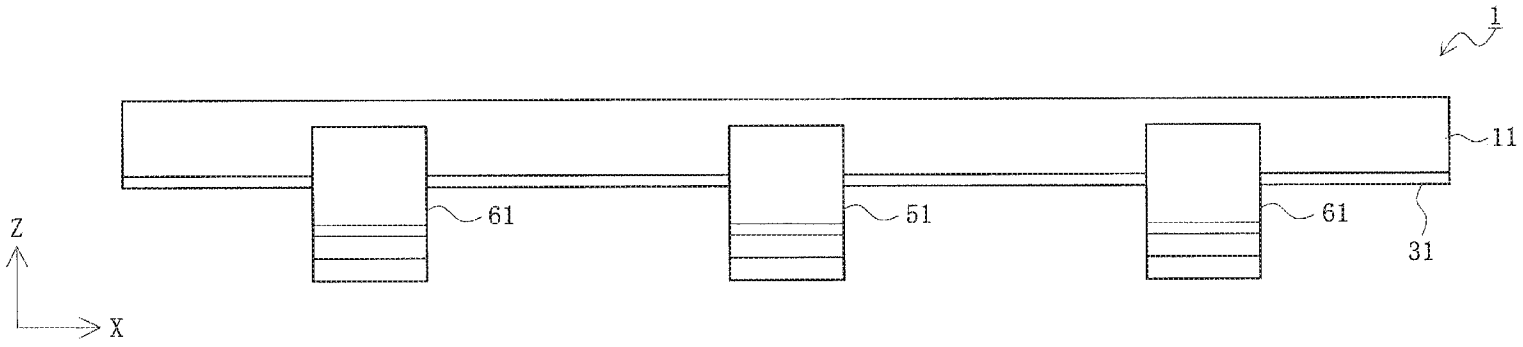
FIG. 3 is a side surface view of the electronic component in the present embodiment.

FIG. 1 is a perspective view illustrating an electronic component in the present embodiment, FIG. 2 is a top surface view of the electronic component in the present embodiment, and FIG. 3 is a side surface view of the electronic component in the present embodiment.

In the figures, 1 is an electronic component in the present embodiment and is, for example, a chip type network resistor including a resistor, that is, a resistor array, but also may be a jumper chip provided with a plurality of jumper wires, or may be something of any type. 1 is described here as a chip type electronic component—provided with a first conductor terminal (1st Terminal) 51 and a second conductor terminal (2nd Terminal) 61 that includes a resistor—that functions as a resistor array. Furthermore, while the electronic component 1 may be used in all types of equipment, such as industrial electric and electronic equipment, household electric and electronic equipment, computers, communication equipment, and the like, the component is described here, for the sake of convenience as, for example, a component mounted on a substrate of a printed circuit board, a flexible flat cable (FFC), a flexible circuit board (FPC), or the like.

Incidentally, in the present embodiment, expressions indicating direction such as up, down, left, right, front, back, and the like that are used for describing the configuration and function of each part that is included in the electronic component 1 are relative terms rather than absolute terms, and are suitable when each part that is included in the electronic component 1 has the position shown in the drawings, but should be interpreted to change based on changes to the position when there is a change in the position of the components included in the electronic component 1.

In the example illustrated in the figures, the electronic component 1 in the present embodiment is provided with a more or less rectangular flat plate like component body 10, and, as conductor terminals, a first conductor terminal 51 and a second conductor terminal 61, which include a first exposed portion 52 and a second exposed portion 62 that are exposed in a width direction (Y axis direction) on both sides from the component body 10. Furthermore, the component body 10 includes a housing 11 formed from an insulating material, such as a heat resistant synthetic resin, and the like, and flat plate conductors 71 as a pair of flat plate like outer conductor members provided on both surfaces of the housing 11 in a vertical direction (Z axis direction). Note that in the example illustrated in the figures, the upper flat plate conductor 71 is exposed (Z axis positive direction), but the lower flat plate conductor 71 has the entire bottom surface covered by an adhesive sheet 31 made of an insulating adhesive material such as an adhesive resin, or the like. Furthermore, the number and arrangement of the first conductor terminal 51 and the second conductor terminal 61 provided as conductor terminals can be set at random, however, for the sake of convenience, the terminals are described here as one of the first conductor terminals 51, provided in the center, and two of the second conductor terminals 61, provided on both sides of, one in front and one behind (in the X axis direction), the first conductor terminal 51.

Additionally, while it is preferable that the dimensions of the X, Y, and Z axis directions of the component body 10 are, for example, 2 to 3 mm, 3 to 4 mm, and 0.2 to 0.3 mm, respectively; the X axis direction dimension of the first exposed portion 52 and the second exposed portion 62 is, for example, 0.25 to 0.35 mm; and the gap (pitch) between the first exposed portion 52 and the second exposed portion 62 is, for example, 0.8 to 1.1 mm; the dimensions of each portion of the electronic component 1 are not limited to this, and can thus be changed as appropriate.

Furthermore, for example, both ends of the first exposed portion 52 of the first conductor terminal 51 are connected to a ground wire of a substrate not illustrated in the figures, and, for example, both ends of the second exposed portion 62 of each of the second conductor terminals 61 are connected to a signal wire of a substrate not illustrated in the figures. Moreover, at least one of the second conductor terminals 61 includes a resistor that is inside the component body 10. Finally, the first conductor terminal 51 is electrically connected to both sides of the flat plate conductor 71 inside the component body 10, and thus, the flat plate conductor 71 functions as an EMI shield member that electromagnetically and effectively shields the electronic component 1.

The internal structure of the electronic component 1 will be described next.

Figure 4:
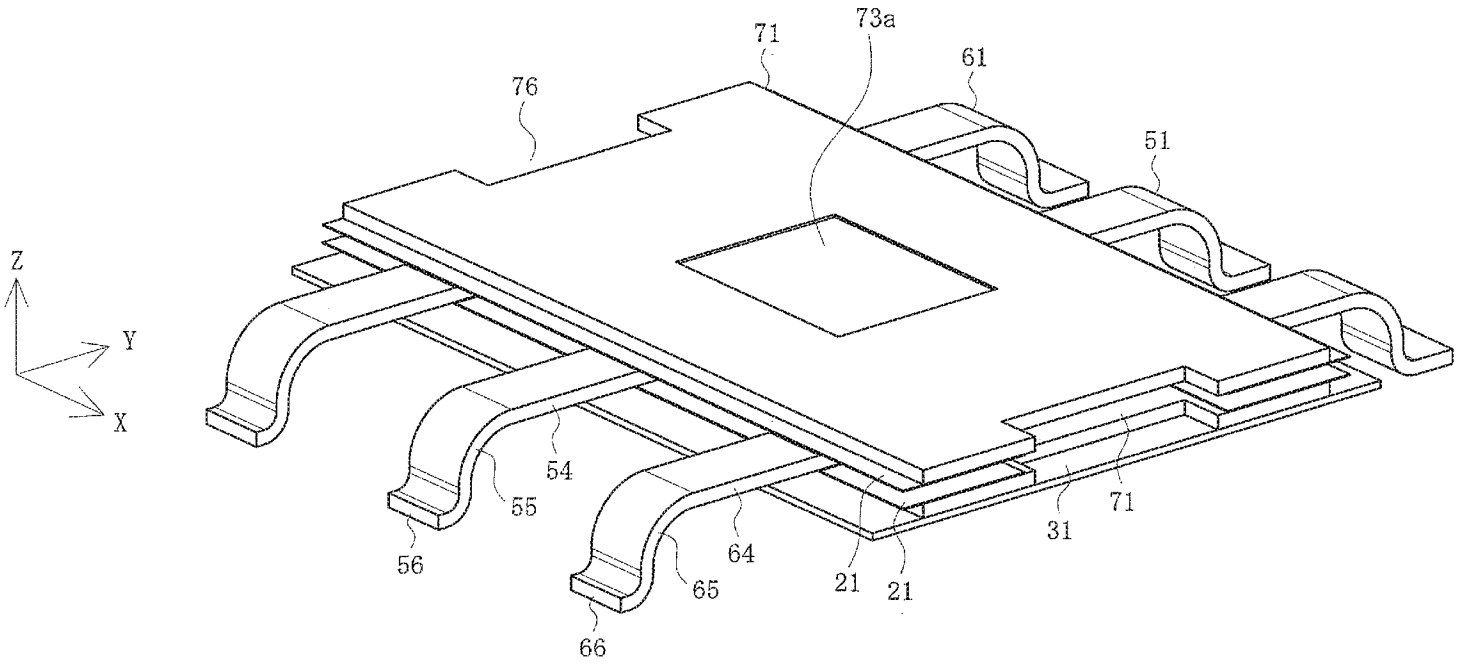
FIG. 4 is a perspective view illustrating the internal structure of the electronic component in the present embodiment.
Figure 5:
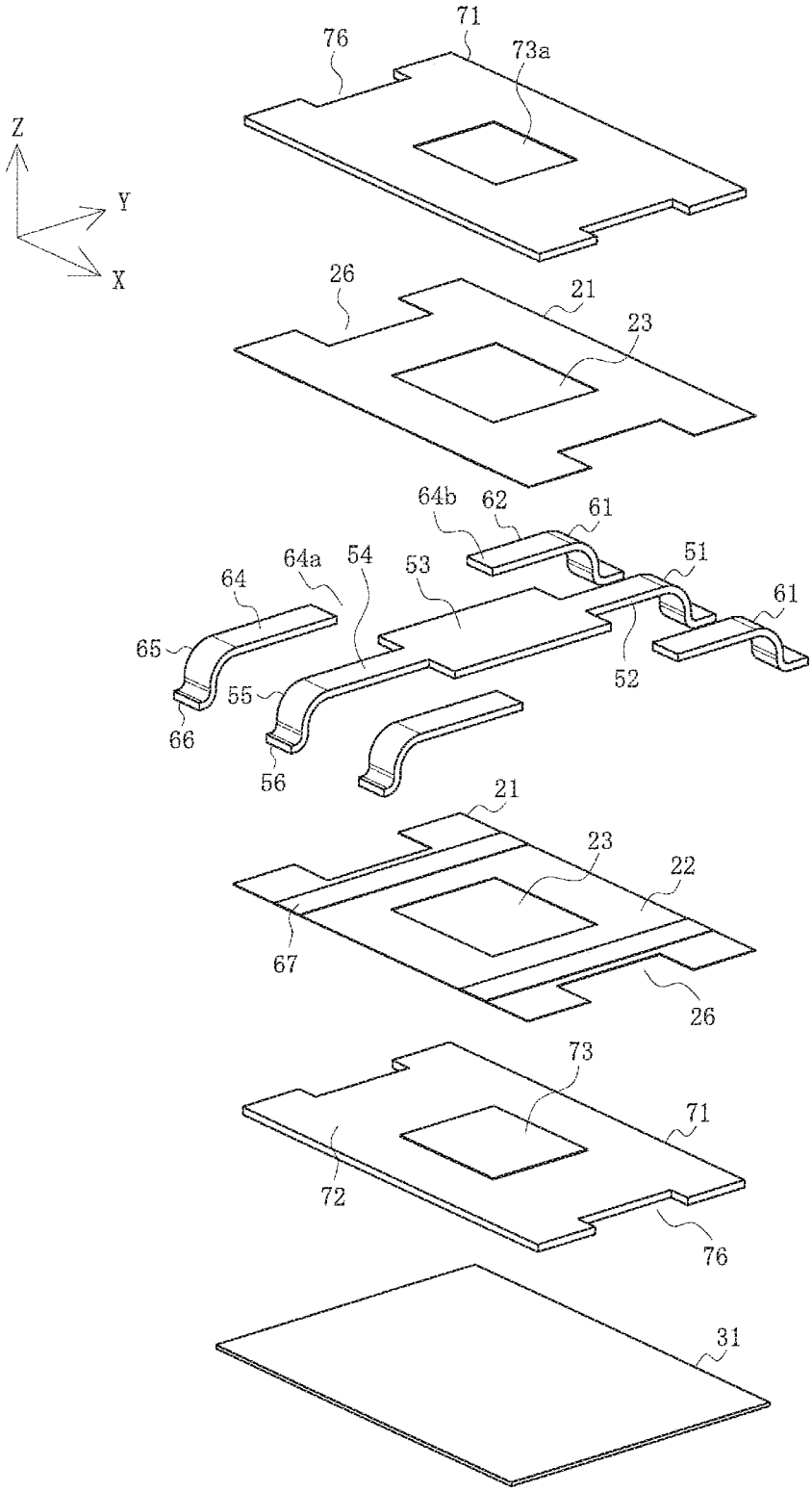
FIG. 5 is an exploded view of the internal structure of the electronic component in the present embodiment.
Figure 6:
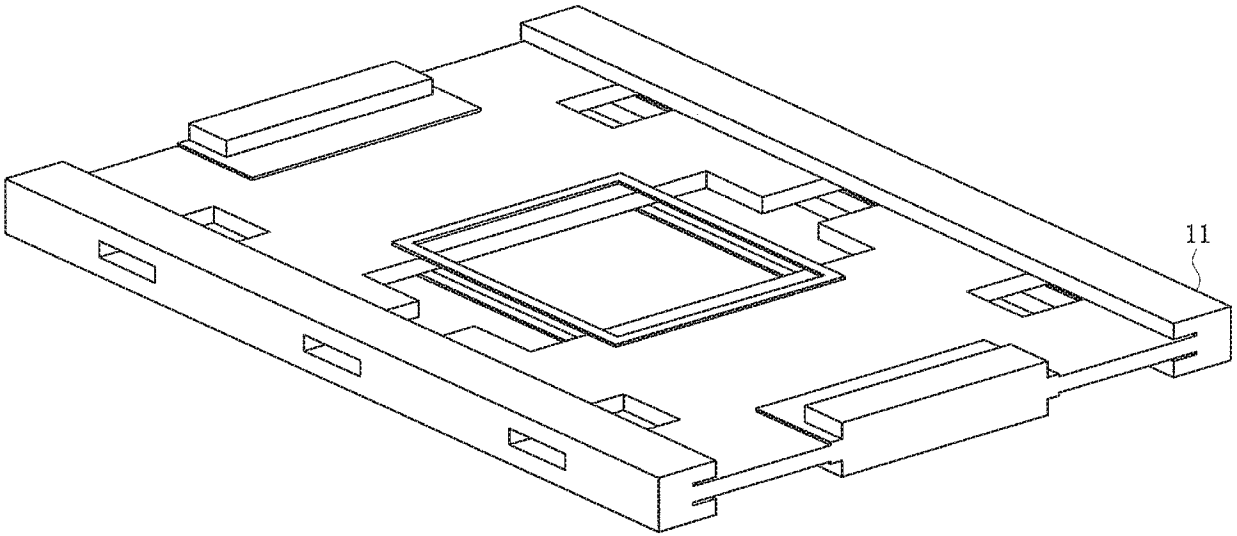
FIG. 6 is a perspective view illustrating a housing in the present embodiment.
Figure 7:
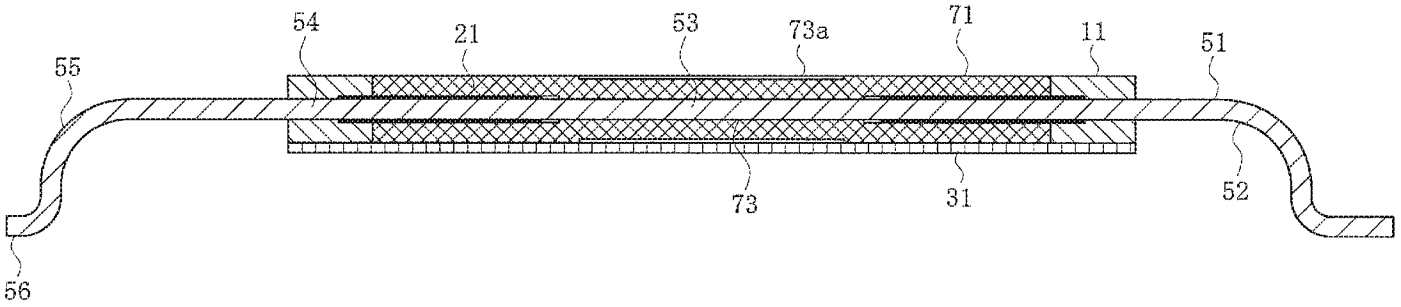
FIG. 7 is a first cross sectional view that is a sectional view along the line indicated by arrows A-A in FIG. 2 of the electronic component in the present embodiment.
Figure 8:
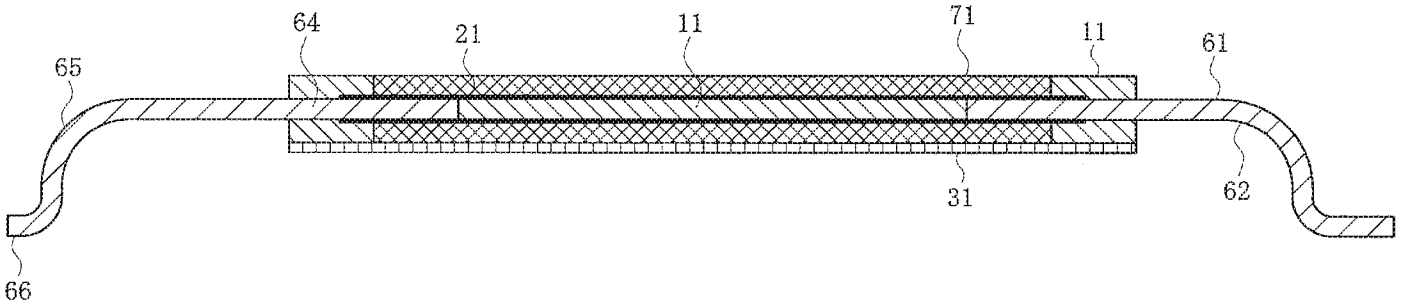
FIG. 8 is a second cross sectional view that is a sectional view along the line indicated by arrows B-B in FIG. 2 of the electronic component in the present embodiment.
Figure 9:
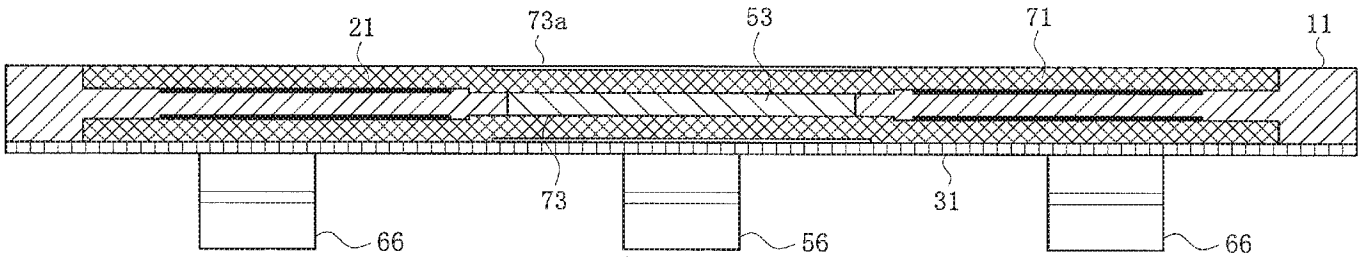
FIG. 9 is a third cross sectional view that is a sectional view along the line indicated by arrows C-C in FIG. 2 of the electronic component in the present embodiment.

FIG. 4 is a perspective view illustrating the internal structure of the electronic component in the present embodiment, FIG. 5 is an exploded view of the internal structure of the electronic component in the present embodiment, FIG. 6 is a perspective view illustrating a housing in the present embodiment, FIG. 7 is a first sectional view cross that is a sectional view along the line indicated by arrows A-A in FIG. 2 of the electronic component in the present embodiment, FIG. 8 is a second cross sectional view that is a sectional view along the line indicated by arrows B-B in FIG. 2 of the electronic component in the present embodiment, and FIG. 9 is a second cross sectional view that is a sectional view along the line indicated by arrows B-B in FIG. 3 of the electronic component in the present embodiment.

The electronic component 1 is provided with the adhesive sheet 31, the flat plate conductor 71, an insulating sheet 21 formed from an insulating material, such as a synthetic resin, and the like, and the first conductor terminal 51 and the second conductor terminal 61. As illustrated in FIG. 4, these members are laminated in the order of, from below, the adhesive sheet 31, the flat plate conductor 71, the insulating sheet 21, the first conductor terminal 51 and the second conductor terminal 61, the insulating sheet 21, and the flat plate conductor 71, furthermore, the electronic component 1, like that illustrated in FIG. 1, can be obtained by performing insert molding (over mold molding) where a mold for molding not illustrated in the figures is filled with a material for the housing 11, such as a synthetic resin, and the like, in a state where a laminate with a structure like that illustrated in FIG. 4 has been placed inside the mold. Thus, a laminate with a structure like that illustrated in FIG. 4 is integrated by the housing 11, which fills some of the gaps in the laminate.

Note that while the shape of the housing 11 is illustrated in FIG. 6, in reality, the housing 11 is not molded using a single body into a shape like that illustrated in FIG. 6, but is rather molded integrally with a laminate like that illustrated in FIG. 4. Moreover, the adhesive sheet 31 may be affixed to the bottom surface of the flat plate conductor 71 and the housing 11 after being excluded from the laminate having a structure like that illustrated in FIG. 4, and after the housing 11 has been formed by performing insert molding.

As illustrated in FIG. 5, the first conductor terminal 51 is a member formed from a ribbon like metal (for example, a Cu alloy plated with Sn) cut from a conductive metal plate, or by stretching a conductive metal material, where a flat plate with a thickness (dimension in the Z axis direction) of, for example, approximately 0.05 mm is further subjected to processes, such as bending, and the like, as needed, and includes a main body portion 54 extending linearly in the Y axis direction, a flat plate conductor connecting portion 53 formed wide in the middle in the longitudinal direction (the Y axis direction) of the main body portion 54, and a tail portion 56 connected to both longitudinal direction ends of the main body portion 54 through a bent portion 55 having an approximately crank shaped cross sectional form. Note that the first exposed portion 52 includes a portion of the main body portion 54, the bent portion 55, and the tail portion 56. Furthermore, a connecting convex portion 73, which is the convex portion of the flat plate conductor 71, makes contact with and is thus electrically connected to both surfaces of the flat plate conductor connecting portion 53 in the vertical direction (Z axis direction). Moreover, the tail portion 56 is in a position spaced outwardly from a width direction outer surface of the housing 11. The bottom surface of the tail portion 56 is connected through soldering, and the like, to a connecting pad linked to a conductive wire of a substrate not illustrated in the figure. While the main body portion 54 and both ends of the tail portion 56 are nearly parallel to one another, interposing the bent portion 55 makes the heights (position in the Z axis direction) thereof different, and thus the main body portion 54 is in a state of being significantly separated from the surface of the substrate, even though the bottom surface of the tail portion 56 is secured to the connecting pad on the surface of the substrate. Note that the flat plate conductor connecting portion 53 does not necessarily have to be formed wide, and thus may be the same width as the other portions of the main body portion 54. Furthermore, the bent portion 55 may be omitted when not needed, and the shape thereof can be changed to correspond with the position of the connecting pad of the substrate.

Moreover, the second conductor terminal 61 is a member formed from a ribbon like metal (for example, a Cu alloy plated with Sn) cut from a conductive metal plate, or by stretching a conductive metal material, where a flat plate with a thickness of, for example, approximately 0.05 mm is further subjected to processes, such as bending, and the like, as needed, and includes a main body portion 64 extending linearly in the Y axis direction, and a tail portion 66 connected to both longitudinal direction ends of the main body portion 64 through a bent portion 65 with an approximately crank shaped cross sectional form. Note that the second exposed portion 62 includes part of the main body portion 64, the bent portion 65, and the tail portion 66. As illustrated in FIG. 5, the center of the main body portion 64 in the longitudinal direction is missing. That is, the main body portion 64 of at least one of the second conductor terminals 61 (both of the second conductor terminals 61 in the example illustrated in FIG. 5) is divided in two in the longitudinal direction by a missing portion 64*a*. Furthermore, a resistor element 67 formed in a terminal facing surface 22 of the insulating sheet 21 makes contact with and is thus electrically connected to at least one surface in at least part of the vertical direction (Z axis direction) in a portion other than the second exposed portion 62 of the main body portion 64, that is, in a remaining portion 64*b* positioned on both ends of the missing portion 64*a*.

Moreover, the tail portion 66 is in a position spaced outwardly from a width direction outer surface of the housing 11. The bottom surface of the tail portion 66 is connected through soldering, and the like, to a connecting pad linked to a conductive wire of a substrate not illustrated in the figure. While the main body portion 64 and both ends of the tail portion 66 are nearly parallel to one another, interposing the bent portion 65 makes the heights thereof different, and thus the main body portion 64 is in a state of being significantly separated from the surface of the substrate, even though the bottom surface of the tail portion 66 is secured to the connecting pad on the surface of the substrate. Furthermore, the bent portion 65 may be omitted when not needed, and the shape thereof can be changed to correspond with the position of the connecting pad of the substrate.

The insulating sheet 21 is preferably a member made of a heat resistant resin, such as a polyimide, polytetrafluoroethylene, and the like, and preferably has a thickness of, for example, approximately 0.025 mm and a more or less rectangular flat plate shape, however, the material and thickness thereof can be changed as appropriate. Moreover, a substantially rectangular opening 23 is formed in the center of the insulating sheet 21 penetrating through the insulating sheet 21 in the thickness direction (Z axis direction). The opening 23 is formed large enough so that the connecting convex portion 73 of the flat plate conductor 71 can pass therethrough. Furthermore, a cutout portion 26 is formed on both ends of the insulating sheet 21 in the X axis direction.

Additionally, the resistor element 67 is affixed as an electrical element to the terminal facing surface 22 in at least one of the two insulting sheets 21 provided on both sides in the Z axis direction of the main body portion 54 of the first conductor terminal 51 and the main body portion 64 of the second conductor terminal 61. There are two of the resistor elements 67 in the example illustrated in FIG. 5, each is a ribbon like slender long thin film like member extending across the entire Y axis direction of the terminal facing surface 22, formed and affixed in a position facing the main body portion 64 of the corresponding second conductor terminal 61.

The resistor element 67 is made from an electrically resistant material such as a carbon paste, a carbon sheet, an oxide, a Ni—Cr powder, a paste of metal material (for example, Ag, Cu, and the like), and the like, however, the element may be made from any type of electrically resistant material. The electric resistance value of the resistor element 67 can be adjusted to a desired value through the appropriate selection of the electrically resistant material. For example, the electric resistance value of the resistor element 67 can be kept low or reduced to zero by selecting a paste or powder of metal material as the electrically resistant material. On the other hand, the electric resistance value of the resistor element 67 can be raised to a high value by selecting a carbon paste, a carbon sheet, an oxide, or the like, as the electrically resistant material. Note that if a metal material is selected as the electrically resistant material, the resistor element 67 can be produced by cutting a metal plate, and a member with the same shape as the first conductor terminal 51 can be formed and then used as the second conductor terminal 61.

The resistor element 67 is described here as slender long thin film with a thickness of, for example, about 0.005 mm formed by hardening and sintering a carbon paste, which is an electrically resistant material, after the paste has been applied to the terminal facing surface 22 of the insulating sheet 21.

The flat plate conductor 71 is a member made from a more or less rectangular flat plate like metal (for example, a Cu alloy plated with Sn) having a thickness of, for example, 0.05 mm formed by being cut out from a conductive metal plate or by stretching a conductive metal material. Furthermore, the connecting convex portion 73 is formed in the center of a surface facing the flat plate conductor connecting portion 53 of the first conductor terminal 51 in each of the flat plate conductors 71, that is, an inner surface 72, facing in the direction of the flat plate conductor connecting portion 53. Because the connecting convex portion 73 makes contact with the flat plate conductor connecting portion 53 through the opening 23 in the insulating sheet 21 and is thus a convex portion electrically connected to the flat plate conductor connecting portion 53, it is preferable that the convex end portion (front end portion) thereof is a flat surface. Moreover, while a concave portion 73*a* is formed in a location corresponding to the connecting convex portion 73 in a surface on the opposite side from the inner surface 72, that is, an outer surface, in the flat plate conductor 71 in the example illustrated in the figure, because the concave portion 73*a* is generated as a result of molding the connecting convex portion 73 using a pressing process, said portion may not exist if a different process is used to mold the connecting convex portion 73. Additionally, a cutout portion 76 is formed on both ends of the flat plate conductor 71 in the X axis direction. Note that the size of the flat plate conductor 71 in the X-Y plane is equal to that of the insulating sheet 21, and that the position of the cutout portion 76 corresponds to the position of the cutout portion 26 of the insulating sheet 21.

The adhesive sheet 31 is a more or less rectangular flat plate like member having a thickness of, for example, approximately 0.04 mm or less cut out from a sheet made of an insulating adhesive material. The size of the adhesive sheet 31 in the X-Y plane is larger than that of the flat plate conductor 71, and equal to the size of the housing 11 in the plane. Note that the adhesive sheet 31 can be omitted when not needed.

Furthermore, the main body portion 64, in the electronic component 1 formed by laminating the adhesive sheet 31, the flat plate conductor 71, the insulating sheet 21, the first conductor terminal 51, and the second conductor terminal 61, is in a state of mutual contact through the resistor element 67 because at least one surface of said portion, which portion is divided in two by the missing portion 64*a* in the second conductor terminal 61, is in contact with and thus electrically connected to the resistor element 67 formed in the terminal facing surface 22 of the insulating sheet 21. Accordingly, the second conductor terminal 61 functions as a resistor, which is a passive element.

Moreover, because the main body portion 64 of the second conductor terminal 61 is separated from the inner surface 72 of the flat plate conductor 71 by the insulating sheet 21, as illustrated in FIG. 8, the first conductor terminal 51 and the second conductor terminal 61 are thus not electrically connected through the flat plate conductor 71. Additionally, because the insulating housing 11 is interposed between the main body portion 54 of the first conductor terminal 51 and the main body portion 64 of the second conductor terminal 61 positioned on both sides of the main body portion, the first conductor terminal 51 and the second conductor terminal 61 are not electrically connected through the flat plate conductor 71.

Furthermore, as illustrated in FIGS. 7 and 9, because the flat plate conductor connecting portion 53 in the first conductor terminal 51 makes contact with and is thus electrically connected to the connecting convex portion 73 of the flat plate conductor 71, the flat plate conductor 71 has the same electrical potential as the first conductor terminal 51 connected to a ground wire. Note that because the main body portion 64 of the second conductor terminal 61 is separated from the inner surface 72 of the flat plate conductor 71 by the insulating sheet 21, as illustrated in FIG. 8, the flat plate conductor 71 electrically shields the signals flowing through the second conductor terminal 61. Moreover, even if parasitic capacitance (stray capacitance) occurs between the main body portion 64 of the second conductor terminal 61 and the flat plate conductor 71, this will be easy to deal with because the size of the parasitic capacitance will be constant.

The method for manufacturing the electronic component 1 will be described next. As one example thereof, a method will be described that obtains the electronic component 1 by molding the housing 11 through insert molding and then adhering the adhesive sheet 31 after forming a laminate by assembling the flat plate conductor 71, the insulating sheet 21, the first conductor terminal 51, the second conductor terminal 61, and the like.

Figure 10:
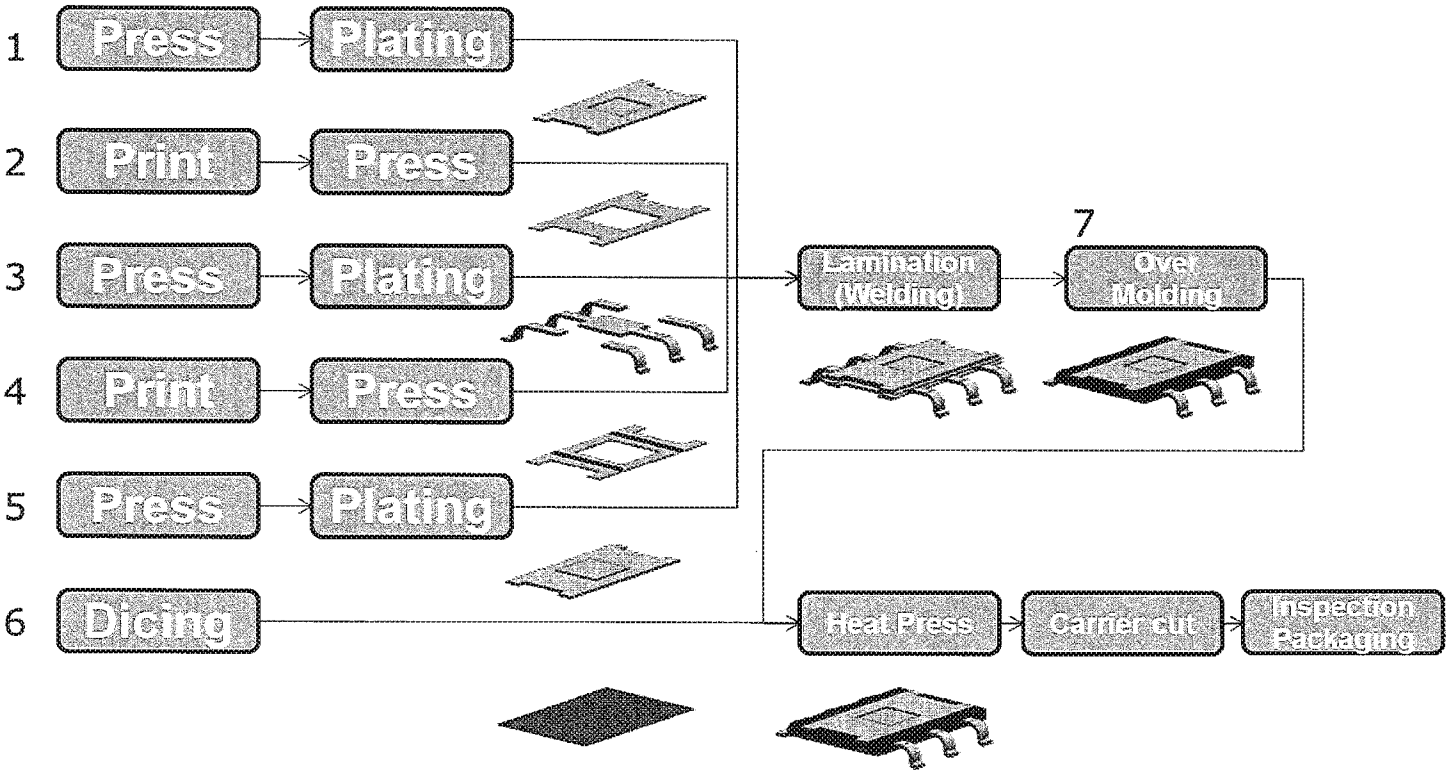
FIG. 10 is a diagram for describing the method for manufacturing the electronic component n the present embodiment.
Figure 11A:
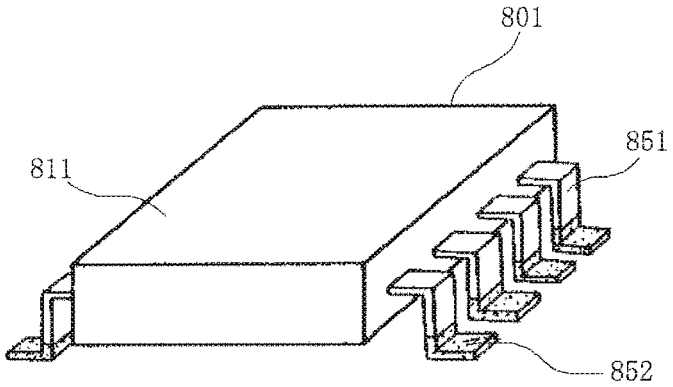
FIG. 11A Prior Art
FIGS. 11A and 11B are diagrams illustrating a conventional electronic component, where
Figure 11B:
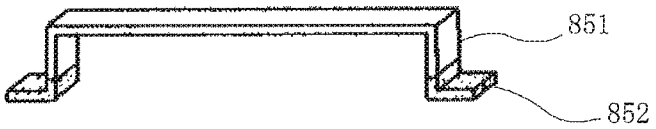
FIG. 11B Prior Art

FIG. 10 is a diagram for describing the method for manufacturing the electronic component in the present embodiment.

First, in a first step, the upper flat plate conductor 71 is obtained by forming an Sn plated coating by applying a plating process to a plate like member given a desired shape by applying a pressing process to a metal plate made of a Cu alloy.

Meanwhile, the lower flat plate conductor 71 is obtained by doing the same thing in a fifth step that was done in the first step.

Furthermore, the upper insulating sheet 21 is obtained in a second step by forming the sheet into a desired shape by applying a pressing process after affixing the resistor element 67 made from an electrically resistant material by applying printing to one surface of a sheet made from a polyimide.

Meanwhile, the lower insulating sheet 21 is obtained by doing the same thing in a fourth step that was done in the second step. Note that the step for affixing of the resistor element 67 can be omitted for either the upper or the lower insulating sheets 21.

Moreover, in a third step, the first conductor terminal 51 and the second conductor terminal 61 are obtained by forming Sn plated coatings by applying a plating process to a plurality of plate like members given desired shapes by applying a pressing process to a metal plate made of a Cu alloy.

Next, the flat plate conductor 71, the upper insulating sheet 21, the first conductor terminal 51 and the second conductor terminal 61, the lower insulating sheet 21, and the lower flat plate conductor 71, obtained in the first through the fifth steps, are placed in a posture like that illustrated in FIG. 5, and then laminated together to form a laminate.

Specifically, first, the first conductor terminal 51 is arranged so that the flat surface thereof faces in the vertical direction (Z axis direction). Next, the second conductor terminal 61 is arranged so as to be separated from the first conductor terminal 51, and so that the flat surface there of faces the vertical direction, on both sides of the first conductor terminal 51 in the transverse direction (X axis direction) thereof. Next, the first conductor terminal 51 and the second conductor terminal 61 are sandwiched by the two insulating sheets 21 from above and below, and then further sandwiched by the two flat plate conductors 71 from above and below. Note that, as was mentioned above, the resistor element 67 is formed in at least one of the insulating sheets 21, and the main body portion 64 of the second conductor terminal 61, divided in two in the Y axis direction, makes contact with and is thus electrically connected to the vicinity of both ends in the Y axis direction of at least the resistor element 67.

Furthermore, it is preferable that the connecting convex portion 73 and the flat plate conductor connecting portion 53 of the first conductor terminal 51, which are in mutual contact with one another, be welded together by either irradiating a laser beam on or bringing the electrodes of a spot welding machine into contact with the concave portion 73*a* from the outside of the flat plate conductor 71. Thus, the mutual separation of the members configuring the laminate can be prevented. Moreover, the state of the electrical connection between the connecting convex portion 73 and the flat plate conductor connecting portion 53 is stabilized. Note that means such as adhesion, pressure, crimping, fusion, and the like, can be appropriately selected in conjunction with the insulating sheet 21 in order to connect the members configuring the laminate together.

Next, in a seventh step, a mold for molding, not illustrated in the figures, in a state with the laminate placed therein is filled with a melted synthetic resin, and then insert molding, that is, over molding, is performed. The housing 11, filled with the synthetic resin so as to fill the space between the two flat plate conductors 71, is configured, and thus the laminate is integrated by the housing 11, which fills some of the gaps in the laminate.

Meanwhile, in a sixth step, the adhesive sheet 31 is obtained by applying a dicing process to a sheet made from an insulating adhesive material to form the sheet into a desired shape.

Furthermore, a heat pressing process is applied in a state where the adhesive sheet 31 is affixed to the bottom surface of the laminate integrated by the housing 11, to thus securely affix the adhesive sheet 31 to the bottom surface of the laminate. This allows the electronic component 1, provided with the component body 10 like that illustrated in FIG. 1, to be obtained.

Note that if a carrier, which is a terminal supporting member not illustrated in the figures, is connected to the ends of the first conductor terminal 51 and the second conductor terminal 61, said carrier is cut.

After being inspected, the electronic component 1 is then stowed in a package not illustrated in the figures.

By providing the electronic component 1 in the present embodiment with the insulating sheet 21, and the first conductor terminal 51 and the second conductor terminal 61 in this way, at least one of the second conductor terminals 61 includes the missing portion 64*a*, and the remaining portion 64*b*, positioned on both ends of the missing portion 64*a*, is connected through the resistor element 67 affixed to the insulating sheet 21.

This allows the electric resistance value of the second conductor terminal 61 to be set to a desired value and thus a desired state to be demonstrated, even if the electronic component 1 is miniaturized. Accordingly, the electronic component 1 can achieve high reliability, low production costs, and high durability.

Moreover, the insulating sheets 21 are provided on both sides of the first conductor terminal 51 and the second conductor terminal 61, and the resistor element 67 is affixed to at least one of the insulating sheets 21 in the terminal facing surface 22. Accordingly, the remaining portion 64*b* of the second conductor terminal 61 can be easily and reliably connected through the resistor element 67 by laminating the first conductor terminal 51 and the second conductor terminal 61 to the insulating sheet 21.

Furthermore, the electronic component 1 is further provided with the flat plate conductor 71 provided on the opposite side of the terminal facing surface 22 in the insulating sheet 21, and includes the first conductor terminal 51 that is electrically connected to the flat plate conductor 71 and the second conductor terminal 61 that is not electrically connected to the flat plate conductor 71, and at least one of the second conductor terminals 61 includes the missing portion 64*a*. Moreover, the flat plate conductor 71 includes the connecting convex portion 73, which makes contact with and is thus electrically connected to the surface of the first conductor 51, and the insulating sheet 21 includes the opening 23 through which the connecting convex portion 73 can pass. Furthermore, the electronic component 1 is further provided with the insulating housing 11, which was formed integrally with the insulating sheet 21, the first conductor terminal 51 and the second conductor terminal 61, and the flat plate conductor 71, and the housing 11 is interposed between the first conductor terminal 51 and the second conductor terminal 61, which are adjacent to one another. Accordingly, the positional relationship between the housing 11 and the first conductor terminal 51 and the second conductor terminal 61, the positional relationship between the first conductor terminal 51 and the second conductor terminal 61, and the positional relationship between the first conductor terminal 51 and the second conductor terminal 61 and the flat plate conductor 71 are kept stable.

Note that the disclosure of the present specification describes characteristics related to preferred and exemplary embodiments. Various other embodiments, modifications and variations within the scope and spirit of the claims appended hereto could naturally be conceived of by persons skilled in the art by summarizing the disclosures of the present specification.

The present disclosure can be applied to an electronic component.

What is claimed is:

1. An electronic component comprising:

a first conductor terminal;

at least one second conductor terminal, the at least one second conductor terminal having first and second parts that are separated from one another by a gap;

an outer conductor member, the outer conductor member being electrically connected to the first conductor terminal, the outer conductor member not being electrically connected to the at least one second conductor terminal;

an insulating sheet, the insulating sheet having first and second surfaces, the first surface of the insulating sheet facing the first terminal and the at least one second conductor terminal, the second surface of the insulating sheet facing the outer conductor member; and at least one resistor element, the at least one resistor element being affixed to the first surface of the insulating sheet, the at least one resistor element being electrically connected to each of the first and second parts of the at least one second conductor terminal.

2. The electronic component as defined in claim 1, wherein the outer conductor member has a protruding portion, wherein the insulating sheet has an opening provided therethrough, and wherein the protruding portion passes through the opening to allow the outer conductor member to be electrically connected to the first conductor terminal.

3. The electronic component as defined in claim 2, wherein the protruding portion is convex.

4. The electronic component as defined in claim 1, wherein the at least one second conductor terminal comprises a pair of second conductor terminals, and wherein the at least one resistor element comprises a pair of resistor elements.

5. The electronic component as defined in claim 4, wherein the first conductor terminal is positioned between the pair of second conductor terminals.

6. The electronic component as defined in claim 1, wherein the first conductor terminal has a main body portion, first and second tail portions, and first and second bent portions, wherein the first bent portion connects the main body portion to the first tail portion, wherein the second bent portion connects the main body portion to the second tail portion, wherein the outer conductor member is electrically connected to the main body portion, and wherein the first and second tail portions are configured to be secured to a substrate.

7. The electronic component as defined in claim 6, wherein the main body portion has an enlarged connecting portion, wherein the outer conductor member is electrically connected to the enlarged connecting portion.

8. The electronic component as defined in claim 1, wherein each of the first and second parts of the at least one second conductor terminal has a main body portion, a tail portion, and a bent portion, wherein the bent portion connects the main body portion to the tail portion, wherein the at least one resistor element is electrically connected to each of the main body portions of the first and second parts of the at least one second conductor terminal, and wherein the tail portion is configured to be secured to a substrate.

9. The electronic component as defined in claim 1, further comprising an adhesive sheet, the adhesive sheet being secured to a surface of the outer conductor member which is not facing the second surface of the insulating sheet.

10. The electronic component as defined in claim 1, further comprising an insulating housing, the insulating housing being integrally formed with the first conductor terminal, the at least one second conductor terminal, the outer conductor member, and the insulating sheet.

11. The electronic component as defined in claim 10, wherein the insulating housing is interposed between the first conductor terminal and the at least one second conductor terminal.

12. An electronic component comprising:

a first conductor terminal;

a pair of second conductor terminals, each one of the pair of second conductor terminals having first and second parts that are separated from one another by a gap;

first and second outer conductor members, each of the first and second outer conductor members being electrically connected to the first conductor terminal, each of the first and second outer conductor members not being electrically connected to the pair of second conductor terminals;

first and second insulating sheets, each of the first and second insulating sheets having first and second surfaces, the first surface of each of the first and second insulating sheets facing the first terminal and the pair of second conductor terminals, the second surface of the first insulating sheet facing the first outer conductor member, the second surface of the second insulating sheet facing the second outer conductor member; and a pair of resistor elements, the pair of resistor elements being affixed to the first surface of the first insulating sheet, the pair of resistor elements being electrically connected to each of the first and second parts of the pair of second conductor terminals, respectively.

13. The electronic component as defined in claim 12, wherein each of the first and second outer conductor members has a protruding portion, wherein each of the first and second insulating sheets has an opening provided therethrough, wherein the protruding portion of the first outer conductor passes through the opening of the first insulating sheet to allow the first outer conductor member to be electrically connected to the first conductor terminal, and wherein the protruding portion of the second outer conductor passes through the opening of the second insulating sheet to allow the second outer conductor member to be electrically connected to the first conductor terminal.

14. The electronic component as defined in claim 13, wherein the protruding portion of each of the first and second outer conductor members is convex.

15. The electronic component as defined in claim 12, wherein the first conductor terminal is positioned between the pair of second conductor terminals.

16. The electronic component as defined in claim 12, wherein the first conductor terminal has a main body portion, first and second tail portions, and first and second bent portions, wherein the first bent portion connects the main body portion to the first tail portion, wherein the second bent portion connects the main body portion to the second tail portion, wherein the first and second outer conductor members are electrically connected to the main body portion, and wherein the first and second tail portions are configured to be secured to a substrate.

17. The electronic component as defined in claim 16, wherein the main body portion has an enlarged connecting portion, wherein the first and second outer conductor members are electrically connected to the enlarged connecting portion.

18. The electronic component as defined in claim 12, wherein each of the first and second parts of the pair of second conductor terminals has a main body portion, a tail portion, and a bent portion, wherein the bent portion connects the main body portion to the tail portion, wherein the pair of resistor elements are electrically connected to each of the main body portions of the first and second parts of the pair of second conductor terminals, respectively, and wherein the tail portion is configured to be secured to a substrate.

19. The electronic component as defined in claim 12, further comprising an adhesive sheet, the adhesive sheet being secured to a surface of the first outer conductor member which is not facing the second surface of the first insulating sheet.

20. The electronic component as defined in claim 12, further comprising an insulating housing, the insulating housing being integrally formed with the first conductor terminal, the pair of second conductor terminals, the first and second outer conductor members, and the first and second insulating sheets.

21. The electronic component as defined in claim 20, wherein the insulating housing is interposed between the first conductor terminal and the pair of second conductor terminals.

* * * * *